US008763329B2

(12) United States Patent
Moseid

(10) Patent No.: US 8,763,329 B2
(45) Date of Patent: Jul. 1, 2014

(54) PRECISE PATIENT TABLE CAVITY FORM

(76) Inventor: Kai N. Moseid, Neillsville, WI (US)

( * ) Notice: Subject to any disclaimer, the term of this patent is extended or adjusted under 35 U.S.C. 154(b) by 250 days.

(21) Appl. No.: 13/182,006

(22) Filed: Jul. 13, 2011

(65) Prior Publication Data

US 2012/0011800 A1 Jan. 19, 2012

Related U.S. Application Data

(60) Provisional application No. 61/363,729, filed on Jul. 13, 2010.

(51) Int. Cl.
*E02D 27/32* (2006.01)

(52) U.S. Cl.
USPC ..... 52/295; 52/126.1

(58) Field of Classification Search
USPC ..... 52/126.1, 292, 294–296, 299, 367, 371, 52/414
See application file for complete search history.

(56) References Cited

U.S. PATENT DOCUMENTS

| | | | | | |
|---|---|---|---|---|---|
| 3,397,494 | A * | 8/1968 | Waring | 52/126.7 |
| 3,771,757 | A * | 11/1973 | Black | 249/219.2 |
| 3,797,800 | A * | 3/1974 | Loy | 249/13 |
| 4,122,645 | A * | 10/1978 | Tooley | 52/651.1 |
| 4,558,544 | A * | 12/1985 | Albrecht et al. | 52/126.6 |
| 5,363,619 | A * | 11/1994 | McPhee | 52/367 |
| 5,564,235 | A * | 10/1996 | Butler | 52/126.6 |
| 5,655,336 | A * | 8/1997 | Azar | 52/126.1 |
| 6,343,439 | B1 * | 2/2002 | Rutledge | 52/27 |
| 6,474,030 | B1 * | 11/2002 | Ueda | 52/292 |
| 8,056,299 | B2 * | 11/2011 | Liskey | 52/742.14 |
| 2003/0053075 | A1 * | 3/2003 | Duhon | 356/500 |
| 2004/0122311 | A1 * | 6/2004 | Cosman | 600/427 |

* cited by examiner

*Primary Examiner* — Brian Glessner
*Assistant Examiner* — Paola Agudelo
(74) *Attorney, Agent, or Firm* — Perkins IP Law Group LLP; Jefferson Perkins

(57) ABSTRACT

A frame for precise casting of concrete comprises a first fascia plate having a score line in a first predetermined location, a second fascia plate having a score line at a second predetermined location a third fascia plate having a score line at a third predetermined location and a fourth fascia plate having a score line at a fourth predetermined location. A precise concrete screed is disposed in a position relative to an upper margin of the fascia plates and allows for formation of a foundation within 2 millimeters in terms of height, position, and levelness.

2 Claims, 6 Drawing Sheets

PRECISE PATIENT TABLE CAVITY FORM

RELATED APPLICATIONS

This application claims priority to U.S. Provisional Patent Application No. 61/363,729 filed Jul. 13, 2010, the specification and drawings of which are fully incorporated by reference herein.

BACKGROUND OF THE INVENTION

The invention relates generally to the art of concrete construction and specifically the pouring and formation of concrete foundations requiring precise dimensional tolerances. Such foundations are needed in the field of medicine because much of the equipment, such as linear accelerators and computed tomography (CT) scanners, are large and heavy but require precise alignment with the surrounding environment. Recently, CT scanners and linear accelerators have been combined into one combined unit that allows for Image Guided Radiation Therapy (IGRT). Specifically, the device locates the tumor inside the patient's body by taking numerous images of the tumor and then forms a three dimensional image of the tumor. The tumor is then irradiated by the linear accelerator portion of the device. IGRT requires the tumor (and therefore the patient, the patient table, and the foundation supporting the table) to be aligned precisely along the "isocenters" of the device in order for the imaging and subsequent radiation to be properly directed. As such, current linear accelerators require the foundation to be within two (2) millimeters of the desired specifications in terms of (1) levelness, (2) position, and (3) height. If the foundation does not meet these exact tolerances, the foundation must be removed, as by chipping or jack-hammering, and re-poured. This process can create large amounts of dust and debris, which must be mitigated and removed, causing additional expenses, delays in construction, and delays with patient care.

Wooden concrete forms are placed into an opening in the slab, or pit, and subsequently adjusted for height and levelness. They allow the formation of concrete boils, or uneven protrusions around the edges, corners, and across the entire lower surface of the finished foundation. These protrusions must be jack-hammered, chipped, patched, and/or ground down. These processes generate silica fumes and construction delays because the area must be sealed from the rest of the building.

Wooden forms are custom-built on-site from ordinary materials that are not custom designed to achieve the precise alignment, positioning, and levelness required by such a precise instrument. Therefore, it would be advantageous to construct a concrete form prior to arriving at the site that aids in pouring a foundation that meets the desired specifications and minimizes installation time, which expedites patient care.

BRIEF DESCRIPTION OF THE DRAWINGS

Aspects of the invention and their advantages can be discerned in the following detailed description, in which like characters denote like parts and in which.

SUMMARY OF THE INVENTION

A frame for precise casting of concrete comprises a first vertical longitudinal fascia plate, a second vertical longitudinal fascia plate, a third vertical transverse fascia plate, and a fourth vertical transverse fascia plate. Each of the longitudinal fascia plates has a transverse score line at a predetermined location and each of the transverse fascia plates has a longitudinal score line at a predetermined location. The second fascia plate is disposed to be spaced from and parallel to the first fascia plate, and the fourth fascia plate is spaced from and parallel to the third fascia plate. Respective ends of the first and second longitudinal fascia plates are affixed to respective ends of the third and fourth fascia plates and a precise concrete screed is disposed in a position relative to an upper margin of the fascia plates.

A method of installing a prefabricated frame having a first fascia plate having a transverse score line at a first predetermined location, a second fascia plate having a transverse score line at a second predetermined location, a third fascia plate having a longitudinal score line at a third predetermined location, and a fourth fascia plate having a longitudinal score line at a fourth predetermined location comprises the steps of surveying an existing footing or subgrade to establish the elevation of the finished floor and locating a plurality of isocenters of a linear accelerator. The method further includes the step of aligning the frame on the footing or subgrade with regard to the linear accelerator isocenters, such that the score lines are within 2 mm of the respective isocenters in terms of height, levelness, and position, pouring concrete in and around the outside of the frame, and allowing the concrete to cure.

DETAILED DESCRIPTION

Figure 1:
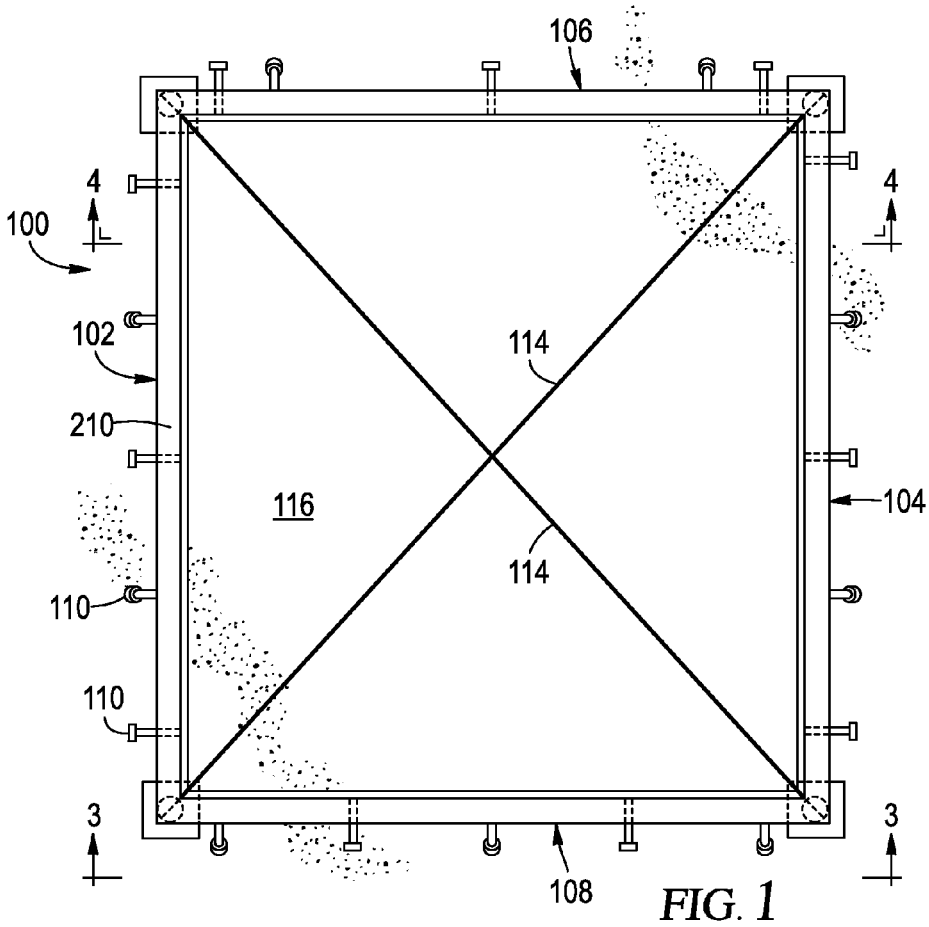
FIG. 1 is a plan view of the frame showing the frame, keeper studs, and longitudinal and transverse fascia plates.
Figure 2:
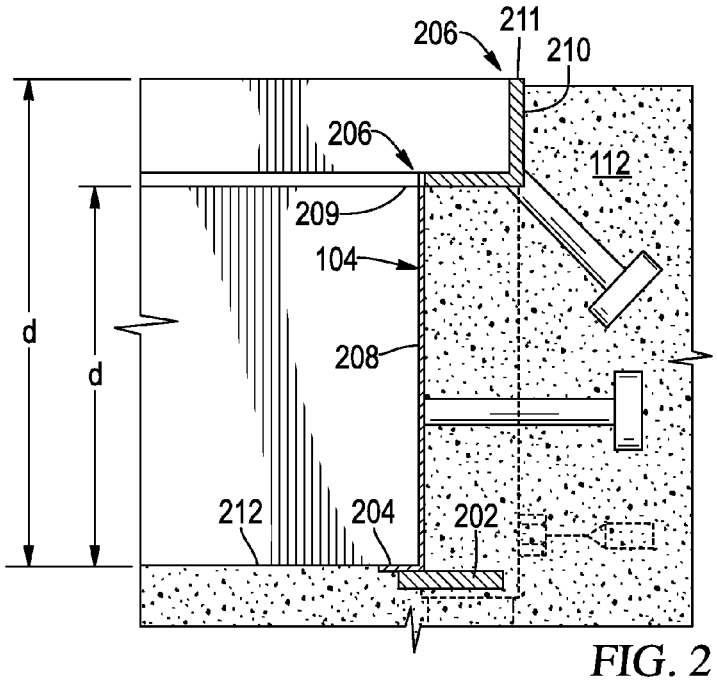
FIG. 2 is a sectional view of a fascia plate showing a vertical panel, an angle-shaped piece, a stiffening plate, and an integrated screed.
Figure 3:
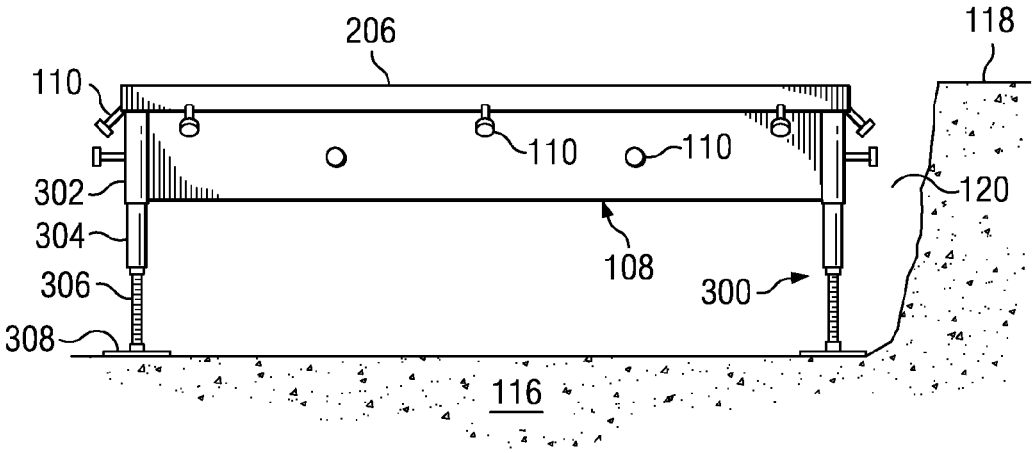
FIG. 3 is a side view of the frame showing the elevation of the frame along line 3-3 of FIG. 1.
Figure 5:
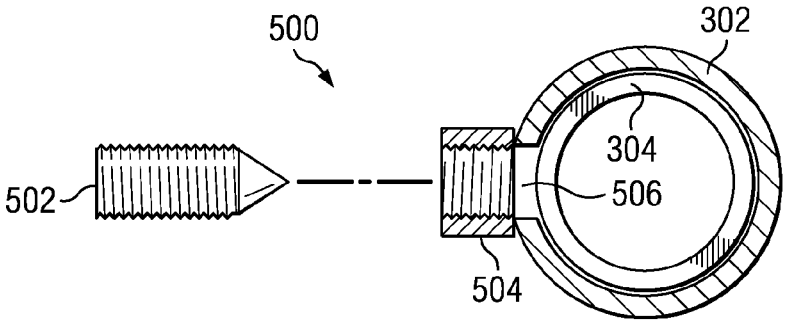
FIG. 5 is a detail of the set bolt used to set the height of the legs shown in FIG. 4.
Figure 4:
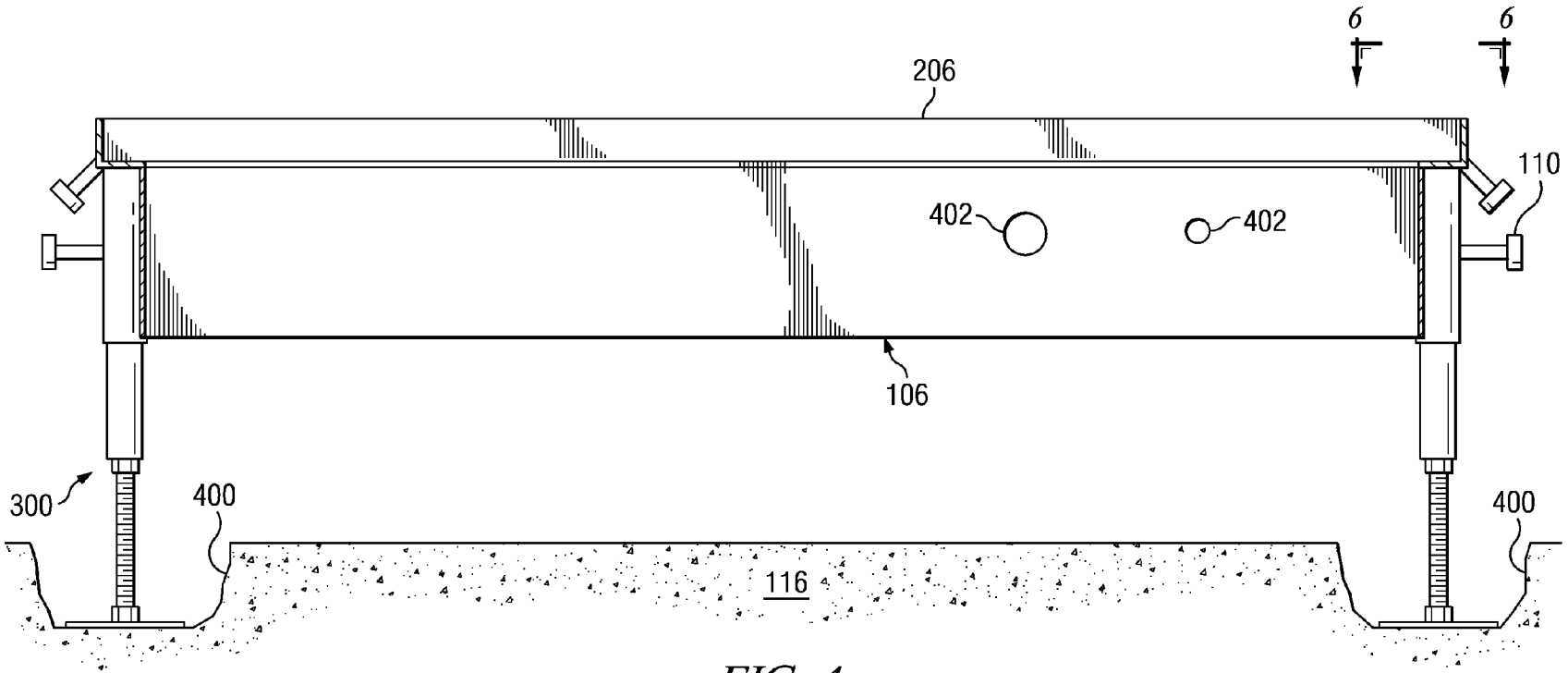
FIG. 4 is a sectional view of the frame showing the frame along line 4-4 of FIG. 1.
Figure 6:
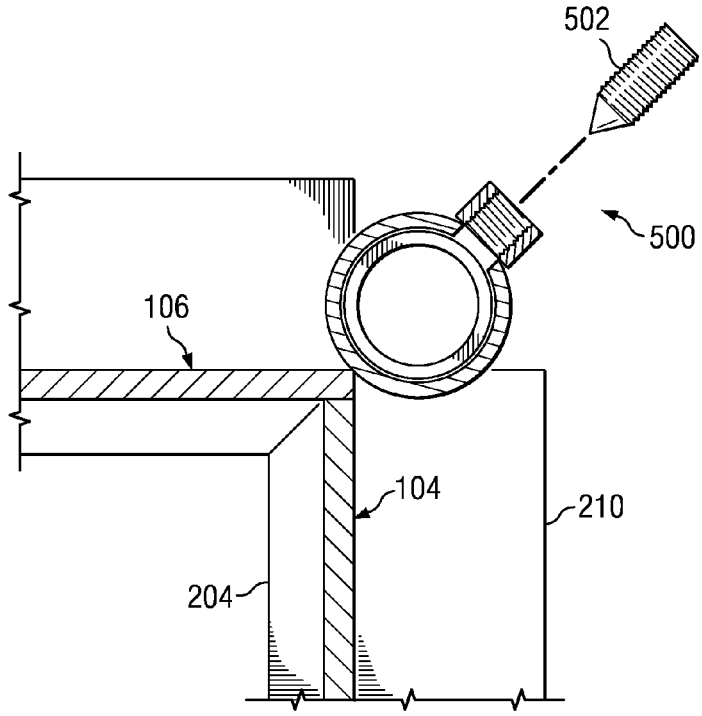
FIG. 6 is a detail showing the attachment of the leg, set bolt, and frame shown along line 6-6 of FIG. 4.

Referring to FIGS. 1 and 2, a frame for the precise casting of concrete, indicated generally at 100, may be formed as part of a new construction or retrofitted into an existing facility. If the frame is installed in a new facility, it is generally placed on a footing/subgrade 116 that is lower than the level of the eventual finished floor (see 118, FIG. 3). If the frame 100 is installed in an existing facility, a pit or opening (see 120, FIG. 3) is cut out of the floor with jackhammers and/or saws.

The frame 100 has a first vertical longitudinal fascia plate 102, a second vertical longitudinal fascia plate 104, a third vertical transverse fascia plate 106, and a fourth vertical transverse fascia plate 108. The first and second fascia plates 102, 104 are disposed to be spaced from and parallel to each other and are affixed to the third and fourth fascia plates 106, 108 at their ends. Thus, when assembled, the fascia plates 102, 104, 106, 108 form a box-like structure, around which a monolithic concrete slab 112 is poured. The fascia plates may be joined by welding mitered ends of the fascia plates to one another. Specifically, the fascia plates 102, 104, 106, 108, as well as the attachments to the frame, may be welded together on the outside surfaces of the fascia plates.

Preferably, the fascia plates 102, 104, 106, 108 are prefabricated of steel plate, but the frame 100 may be made of other materials instead. Once the frame 100 is completely assembled it may be primed and painted.

Figure 8:
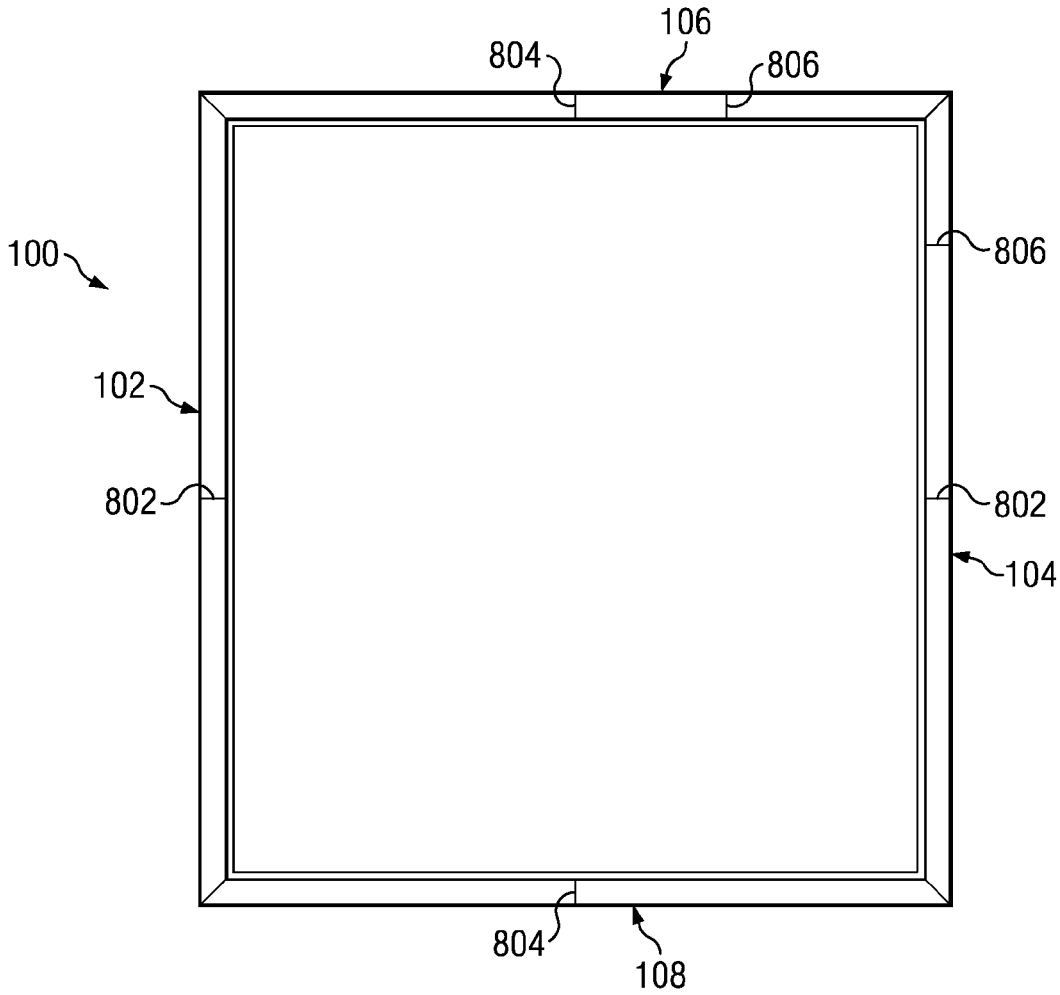
FIG. 8 is plan view of the frame showing representative locations for the score lines and the electrical conduit locations.

As shown in FIG. 8, each of the longitudinal fascia plates 102, 104 has a transverse score line 802 at a predetermined location, and each of the transverse fascia plates 106, 108 has a longitudinal score line 804 at a different predetermined location. The score lines 802, 804 allow the frame 100 to be precisely positioned in the pit 120 (FIG. 3) so that the frame 100, and the resulting foundation, are precisely aligned with the medical equipment per the manufacturer's specifications, typically within two (2) millimeters. The score lines 802, 804 may or may not be placed directly in the centers of the fascia plates 102, 104, 106, 108. Rather, the score lines 802, 804 are placed to align with the isocenters (not shown) of the linear accelerator (also not shown) and, therefore, are predetermined by the manufacturer's specifications.

Keeper studs, or Nelson studs, 110 may be affixed, as by welding, to the outside of the fascia plates 102, 104, 106, 108 to help anchor the fascia plates 102, 104, 106, 108 into the concrete slab 112. Temporary internal bracing 114, such as steel tubing, or wooden supports may be tack welded to or abutted against the inside surfaces of the assembled fascia plates 102, 104, 106, 108 to prevent deformation during shipping. Alternatively, as shown in FIG. 2, a steel plate 202 or other reinforcing structures can be added to the outside of the fascia plates 102, 104, 106, 108 to increase the overall strength of the frame 100.

FIG. 2 shows a cross-section of a typical fascia plate. The vertical panel 208 of each fascia plate 102, 104, 106, 108 may be joined to an angled or L-shaped piece 210. Thus, an upper margin 206 of the fascia plates 102, 104, 106, 108 may be formed either by an upper end 209 of the vertical panel 208 or the top edge 211 of the angle piece 210. The angled piece 210 further increases the structural strength of the frame 100 so that it may better resist the forces of the concrete.

The frame 100 also includes a precise concrete screed 204 that is disposed in a position relative to an upper margin 206 of the fascia plates and is used for forming, leveling, and finishing a concrete surface. The screed 204 allows the lower surface 212 of the foundation to be precisely leveled and finished to be flush with the top of the screed 204, generally within two (2) millimeters of the linear accelerator manufacturer's specified depth and levelness. The top of the screed 204 is positioned a predetermined distance "d" from the upper margin 206 of the fascia plates 102, 104, 106, 108, which, as described above, may or may not include the L-shaped piece 210. The screed may be integrally formed with at least two (and more preferably four) of the fascia plates 102, 104, 106, 108 by bending a bottom section of the respective fascia plates to be at substantially a right angle to the vertical panels 208 of the fascia plates 102, 104, 106, 108. Alternatively, the screed 204 may be separate from the fascia plates and affixed as by welding to the vertical panels 208.

As shown in FIGS. 3-7, the frame 100 may include adjustable legs, indicated generally at 300 that are affixed to the frame 100. In affixing the legs 300 to the frame 100, it may be necessary to cut the reinforcing plate 202 and/or the L-shaped piece 210 in order to accommodate placement of the legs.

Figure 7:
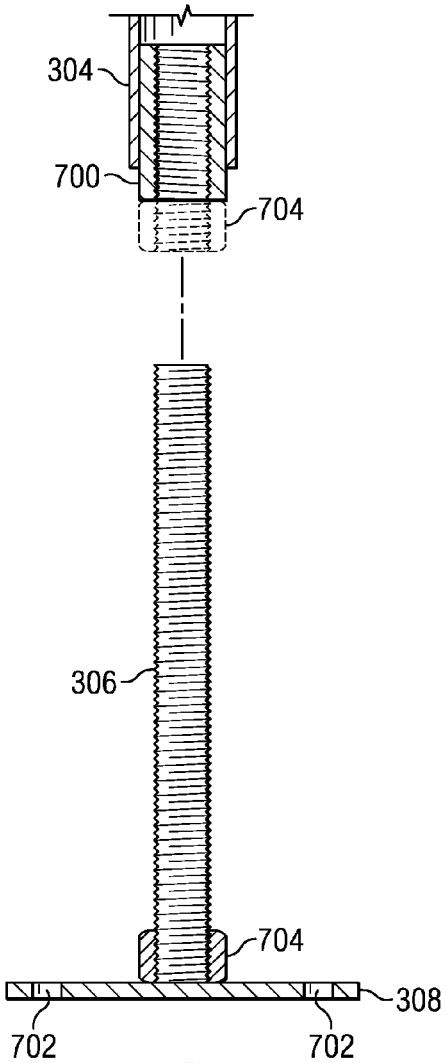
FIG. 7 is a detail of the adjustable legs shown in FIGS. 3 and 4.

While the legs 300 need not be formed of tubular materials, FIG. 7 shows that each leg 300 may have a housing 302 that is affixed to the frame 100 (see FIG. 6) and an adjustable inner leg 304. The adjustable inner leg 304 fits inside the housing 302 and is secured to the housing 302 with a set bolt assembly, indicated generally at 500 (see FIG. 5). Each set bolt assembly 500 has a set bolt 502 which screws into a threaded set bolt nut 504 that has been affixed to the outside of the housing 302, passes through a hole 506 in the housing 302 and secures the inner leg 304, preventing movement of the inner leg 304 in the housing 302.

In the illustrated embodiment, the leg 300 also includes a threaded shaft 306 and a bearing plate, or foot, 308 which sits on the bottom of the footing or subgrade 116 and supports the leg 300 and frame 100. The shaft 306 may be threadably inserted into a nut 700 that is affixed to the inner leg 304, thereby allowing the overall length of the leg to be adjusted upward or downward by rotating the shaft 306. Once the proper length of each leg has been set, a jamb nut 704 (see FIG. 7) that has been threaded onto the shaft may be tightened against the nut 700 to prevent unwanted movement. In this manner, the frame 100 can be precisely adjusted to the proper height and levelness to within the two millimeter tolerance.

Additionally, the foot 308 is affixed onto the lower end of the shaft 306 and has anchor holes 702 through which the foot 308 can be anchored to the existing footing or subgrade 116. The foot may take a variety of shapes and sizes, but round or rectangular feet with a width/diameter of six (6) inches are preferred. Alternatively, the feet or legs can be grouted into the opening to prevent movement of the frame 100 once the frame has been aligned with the isocenters and the height of the frame 100 has been adjusted to meet the manufacturer's specifications. Thus, the concrete screed 204, the adjustable legs 300, and the score marks 802, 804 allow the frame 100 (and, therefore, the foundation) to be precisely positioned within two millimeters of the desired location.

Returning to FIG. 8, it can be seen that the frame 100 not only has predetermined score marks 802, 804 that assist in positioning the frame 100, but it also may have electrical position markings 806 at predetermined locations that assist in locating and installing conduit and the associated wiring. The score marks 802, 804 and electrical position markings 806 may be stamped onto the frame 100, affixed with labels, or by any other means of labeling.

In another aspect of the invention, a method of installing the frame, indicated generally at 900, can be applied in new or existing facilities. In existing facilities, it is usually necessary to break up (902) floor and/or underlying concrete and remove the debris, forming a pit or opening 120 where the foundation is to be formed so that the frame 100 can be placed within the pit 120. If the foundation is being installed in a new facility this step is typically not necessary.

The method further includes the step of surveying (904) the footing/subgrade 116 to establish the finished floor elevation and locating (906) isocenters associated with the linear accelerator (not shown). These isocenters may be marked (908) on the footing/subgrade 116 and the frame 100 is aligned (910) with the isocenters. Both the location of the isocenters and the finished floor 118 elevation should be protected so as to provide constant reference points during the installation.

The height of the frame 100 may be adjusted (914) by assembling (916) the legs 300 and adjusting (918) and overall length of the leg 300. Specifically, the overall length of the leg 300 may be adjusted (918) by screwing the shaft 306 into the shaft nut 700 of the inner leg 304, inserting the inner leg 304 into the housing 302, and affixing the housing 302 to the inner leg 304 with the set bolt 502. The frame height is the verified with an optical level or equal calibrated leveling device. It is often necessary to repeat the height and alignment measurements several times throughout the process to ensure the frame 100 is precisely positioned.

Figure 9:
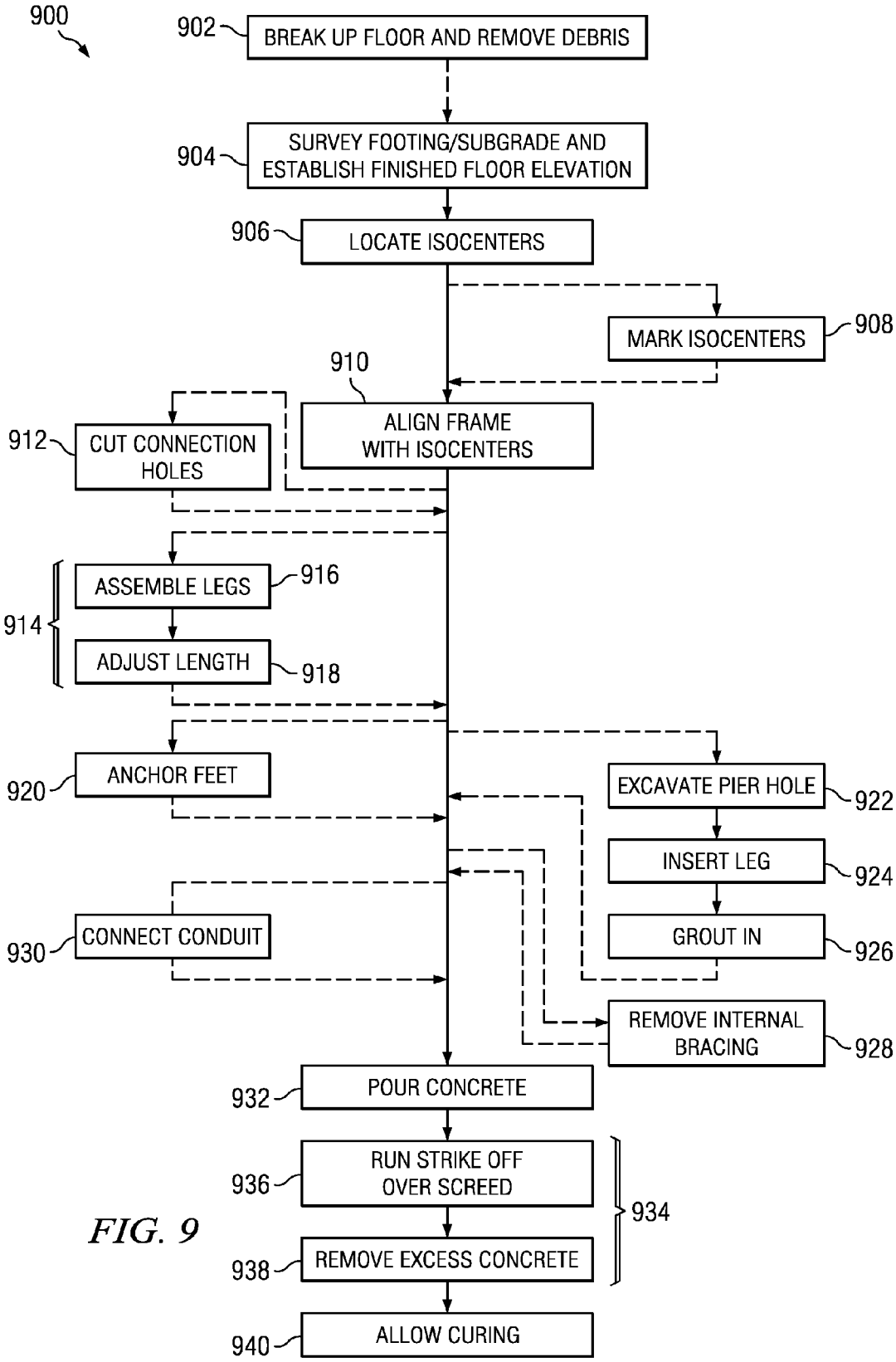
FIG. 9 is a flow diagram showing a method of installing the prefabricated frame.

In the event that no slab or foundation exists, the frame 100 must be placed on the footing/subgrade 116 approximately where the foundation is to be located. The installers then survey (904) the footing/subgrade 116 to establish the elevation of the finished floor and to ensure that the footing/subgrade 116 meets the manufacturer's specifications. Pier holes 400 may be excavated (922) (see FIGS. 4 and 9), a portion of the leg 300 is inserted (924) into the pier hole 400, and the feet 308 are grouted (926) in place and allowed to cure to prevent movement. The depth of the pier holes 400 is preferably eight (8) inches below the top of the subgrade 116.

Alternatively, the feet 308 of the leg 300 can be anchored (920) to the footing/subgrade 116. One or more anchors (not shown) can be inserted through the holes 702 in the foot 308 and penetrate into the footing/subgrade 116.

Connection holes 402 (FIG. 4) for electrical conduit and other features may be cut (912) into the frame 100 either before or after securing the frame 100 to the footing/subgrade 116 and according to the electrical position markings 806 on the frame. The installer then removes (928) any internal bracing 114, connects (930) conduit and other attachments, and pours (932) the concrete into and around the outside of the frame 100.

It is important to note that the frame 100 allows the formation of a monolithic foundation and slab, which is critical in some applications. The depth of the lower surface 212 from the eventual or existing finished floor 118 is set according to the manufacturer's specifications, and the lower surface 212 is created (934) by running (936) a strike off (not shown) over the screed 204, usually multiple times, to level the surface 212. Finally, the installer removes (938) excess liquid concrete and the concrete is allowed (940) to cure. It is not necessary to use the strike-off once the concrete has set to the point that it ceases to flow.

While embodiments of the present invention have been described as above and illustrated in the appended drawings, the present invention is also shown and described in the following pictures, descriptions, instructions, and other printed material below, which is explicitly included as part of the this specification.

I claim:

1. A frame for precise casting of concrete comprising:

a first vertical longitudinal fascia plate;

a second vertical longitudinal fascia plate disposed to be spaced from and parallel to the first fascia plate;

a third vertical transverse fascia plate affixed to first ends of the first and second fascia plates;

a fourth vertical transverse fascia plate spaced from and parallel to the third fascia plate and being affixed to second ends of the first and second fascia plates;

a precise concrete screed disposed in a position relative to an upper margin of the fascia plates; and a plurality of adjustable legs affixed to the frame, each leg including a housing;

an adjustable inner leg insertable into the housing;

a set bolt assembly affixed to the housing, the set bolt assembly comprising a set bolt threadably insertable into a set bolt nut and passing through a hole in the housing, an abutting end of the set bolt securing the housing to the inner leg;

a shaft threadably insertable into a nut affixed to the inner leg; and a foot affixed to a lower end of the shaft.

2. The frame of claim 1, further comprising at least one anchor hole in the foot.

* * * * *